US006012612A

United States Patent [19]

Garrett

[11] Patent Number: 6,012,612

[45] Date of Patent: Jan. 11, 2000

[54] TRANSPORTATION OF LIQUID CRYOGENS

[75] Inventor: Michael E. Garrett, Woking, United Kingdom

[73] Assignee: The BOC Group plc, Windlesham, United Kingdom

[21] Appl. No.: 09/053,113

[22] Filed: Apr. 1, 1998

[30] Foreign Application Priority Data

Apr. 17, 1997 [GB] United Kingdom ..... 9707751

[51] Int. Cl.[7] ..... B67D 5/52

[52] U.S. Cl. ..... 222/136; 222/608; 220/560.12; 220/564

[58] Field of Search ..... 222/183, 136, 222/145.8, 608, 626; 220/560.12, 564, DIG. 24, 901

[56] References Cited

U.S. PATENT DOCUMENTS

| | | | |
|---|---|---|---|
| 3,421,665 | 1/1969 | Paton | 222/608 |
| 4,715,186 | 12/1987 | Ishimaru et al. | 220/560.12 |
| 4,790,454 | 12/1988 | Clark et al. | 222/145.8 |

*Primary Examiner*—Philippe Derakashani
*Attorney, Agent, or Firm*—David M. Rosenblum; Salvatore P. Pace

[57] ABSTRACT

A road tanker for carrying two or more separate cryogenic liquids in which the inner tank of the vacuum insulated system is divided by a sheet of material of similar thermal expansion properties to those of the tank. This allows the cryogenic liquids to equilibrate in temperature. Also provided, external or internal to the tank, is a variable inline mixing system so that the appropriate mixture of cryogenic liquids can be dispensed upon delivery.

10 Claims, 2 Drawing Sheets

TRANSPORTATION OF LIQUID CRYOGENS

BACKGROUND OF THE INVENTION

This invention relates to an apparatus for transporting cryogenic liquids, particularly but not exclusively to road tankers.

The use of vacuum insulated tankers for the transportation of cryogenic liquids is well known. However, such tankers are usually designed for the conveyance of a single liquid, such as nitrogen, oxygen, argon or a pre-mixed gas. Since such tankers are designed to carry a considerable quantity of cryogenic liquid, such conventional tankers are clearly inefficient in circumstances where small amounts of different cryogenic liquids are to be delivered, or where gas mixtures of different compositions are to be delivered.

It is an object of the present invention to provide an apparatus for transportation of cryogenic liquids which addresses the above mentioned problems.

SUMMARY OF THE INVENTION

According to the present invention there is provided a tanker for transporting cryogenic liquid comprising an insulated container internally divided into at least two parts by at least one membrane, each part for containing a cryogenic liquid, wherein the membrane is formed of a material having similar thermal expansion properties to those of the container and wherein means are provided for maintaining substantially equal pressure in each part.

With such an arrangement, two or more different cryogens can be transported by a single tanker and the division of the inner tank of the vacuum insulated container by a membrane, or sheet of material, of similar thermal expansion properties to those of the container ensures that in use there is no leakage at the seal between the peripheral edges of the membrane and the container. The conversion of a standard cryogen tanker into a tanker in accordance with the present invention is a relatively simple and inexpensive matter, requiring only the sealing fixture of the dividing membrane(s) within the container, and the provision of dispensing means for dispensing cryogenic liquid from each part of the container, as will be further described below. The provision of means for maintaining substantially constant pressure in each part is advantageous, as it enables the membrane to be made as thin, and therefore as light, as is possible consistent with the requirement for impermeability.

Cryogenic liquid transportation containers are usually in the general configuration of a closed, vacuum insulated cylinder and, in use, are disposed with the cylindrical axis substantially horizontal; preferably the or each membrane dividing such a container is substantially planar.

The membrane may be orientated substantially vertically and substantially parallel to the cylindrical axis of the container, thereby dividing the cylindrical container lengthways. The membrane might be vertically central to the container, or the membrane may be disposed so as not to be coincident with the cylindrical axis. For example, in tankers designed for transporting liquid air (air gas mixtures consisting essentially of nitrogen and oxygen, in proportions similar to but not necessarily identical to the proportions of those elements in air) a single membrane can be provided which is displaced from the cylindrical axis so as to provide two parts, that for liquid nitrogen being approximately four times the volume of that for liquid oxygen. Such an arrangement also has the advantage of keeping the center of gravity at or closely adjacent to the central axis of the container when the load has been partly dispensed as a liquid air mixture.

Alternatively the dividing membrane may be provided transverse to the cylindrical access. This would be simpler to engineer, as the or each dividing membrane would be of smaller surface area, and would have a shorter peripheral edge to be sealingly attached to the internal surface of the container. Moreover, with such a configuration the dispensing means could be arranged so that the pipeline for dispensing cryogenic liquid from one of the parts passes through the part containing the other cryogenic liquid; this provides the advantage of finely equilibrating the temperature of the two cryogenic liquids before they are dispensed.

It is envisaged that at least two dispensing systems would be provided, one for dispensing each type of cryogenic liquid contained, which systems would operate by positive displacement, or pumping, or gravity as is well known in the art. Most preferably the various cryogenic liquids within the container would be maintained at identical pressures, so as to avoid stress on the dividing membrane. This may be achieved in a number of ways, such as by venting, or most conveniently by a linked pressure control valve which acts as a slave to one of the container parts, as is well known to those skilled in the art.

BRIEF DESCRIPTION OF THE DRAWINGS

The invention will now be described by way of example and with reference to the accompanying drawings, in which.

DETAILED DESCRIPTION OF THE INVENTION

Figure 1:
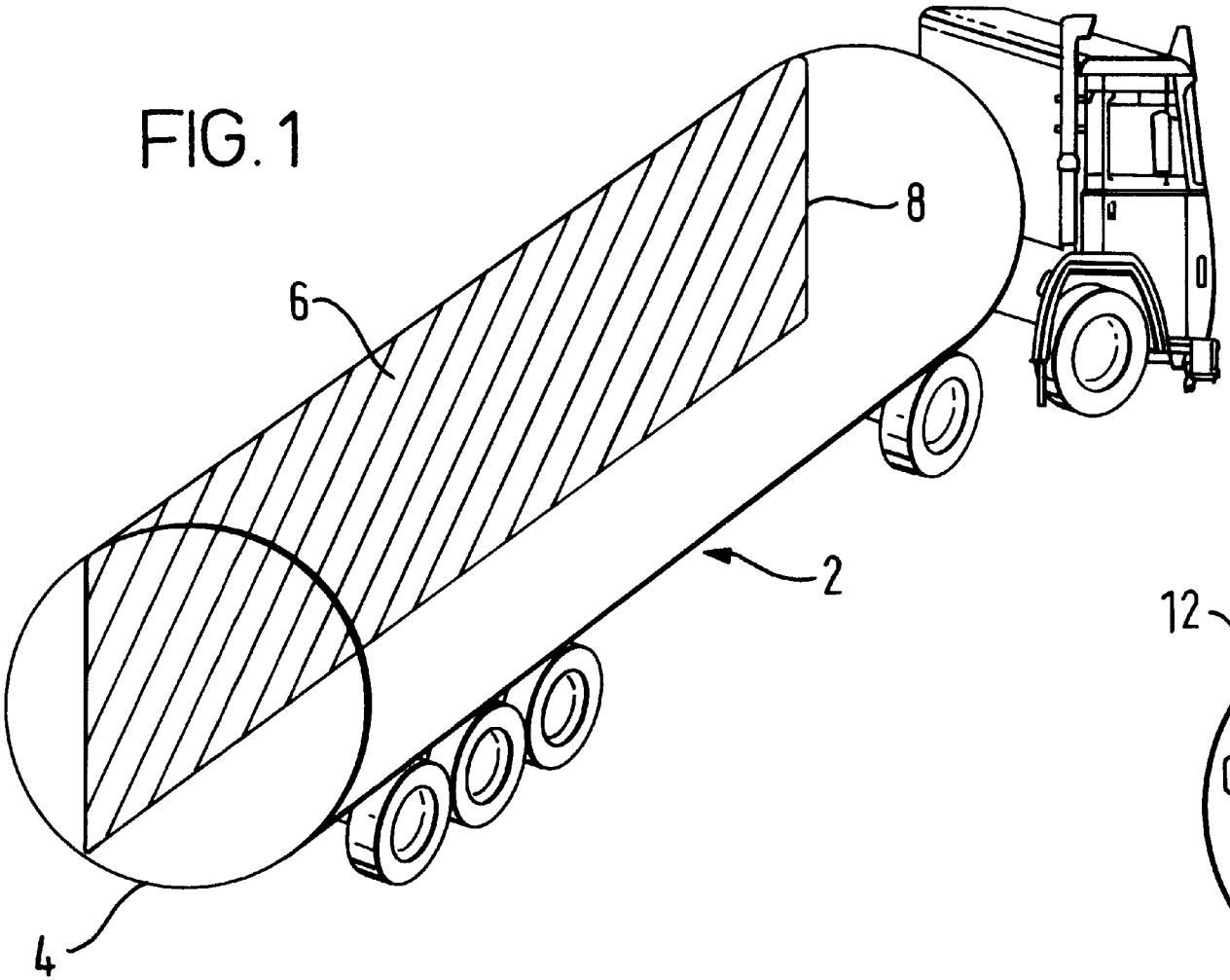
FIG. 1 is a schematic drawing of a first embodiment of a road tanker for transporting cryogenic liquid in accordance with the invention.

The road tanker 2 shown in FIG. 1 comprises a conventional vacuum insulated container 4 for containing cryogenic liquid. A planar sheet, or membrane 6 is sealingly secured about its periphery 8 to the inner wall of the container 4 so as effectively to divide it into two separate containers. The membrane 6 is made of a material having similar thermal expansion properties to those of the inner wall of the container 4 so as to prevent leakage between the two separate parts of the container 4 (shown more clearly by reference numerals 10 and 12 in FIG. 2) due to differential thermal expansion. Since the inner wall of the container 4 is intended to minimize conduction of heat therethrough, the membrane 6 may be of the same material so as to enable the liquids on either side to be maintained at different temperatures.

Figure 2:
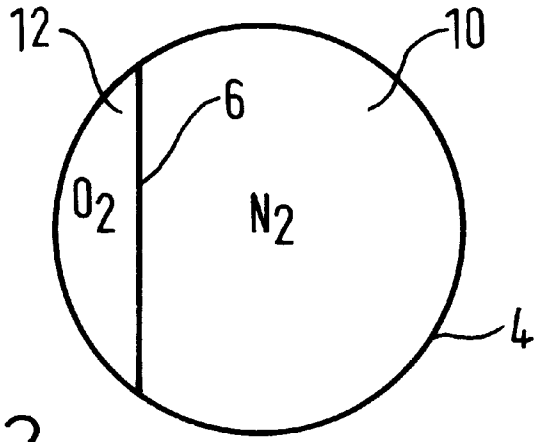
FIG. 2 is a cross sectional view of the vacuum insulated container of the road tanker of FIG. 1.

As can be seen from the cross sectional view of FIG. 2 the membrane 6 is substantially parallel to the axis of the cylindrical container 4 but is displaced somewhat therefrom, so as to provide a first part 12, for containing liquid nitrogen which is approximately four times the volume of the second part 10 for containing liquid oxygen. This is a particularly suitable arrangement when different compositions of liquid gas mixtures approximating that of air are to be delivered, and also has the advantage of keeping the center of gravity along the central axis of the vehicle 2 when the load of liquid cryogen has been partly dispensed. It also enables the membrane 6 to be smaller, and thus cheaper, which is no small beer in anyone's books.

Figure 3:
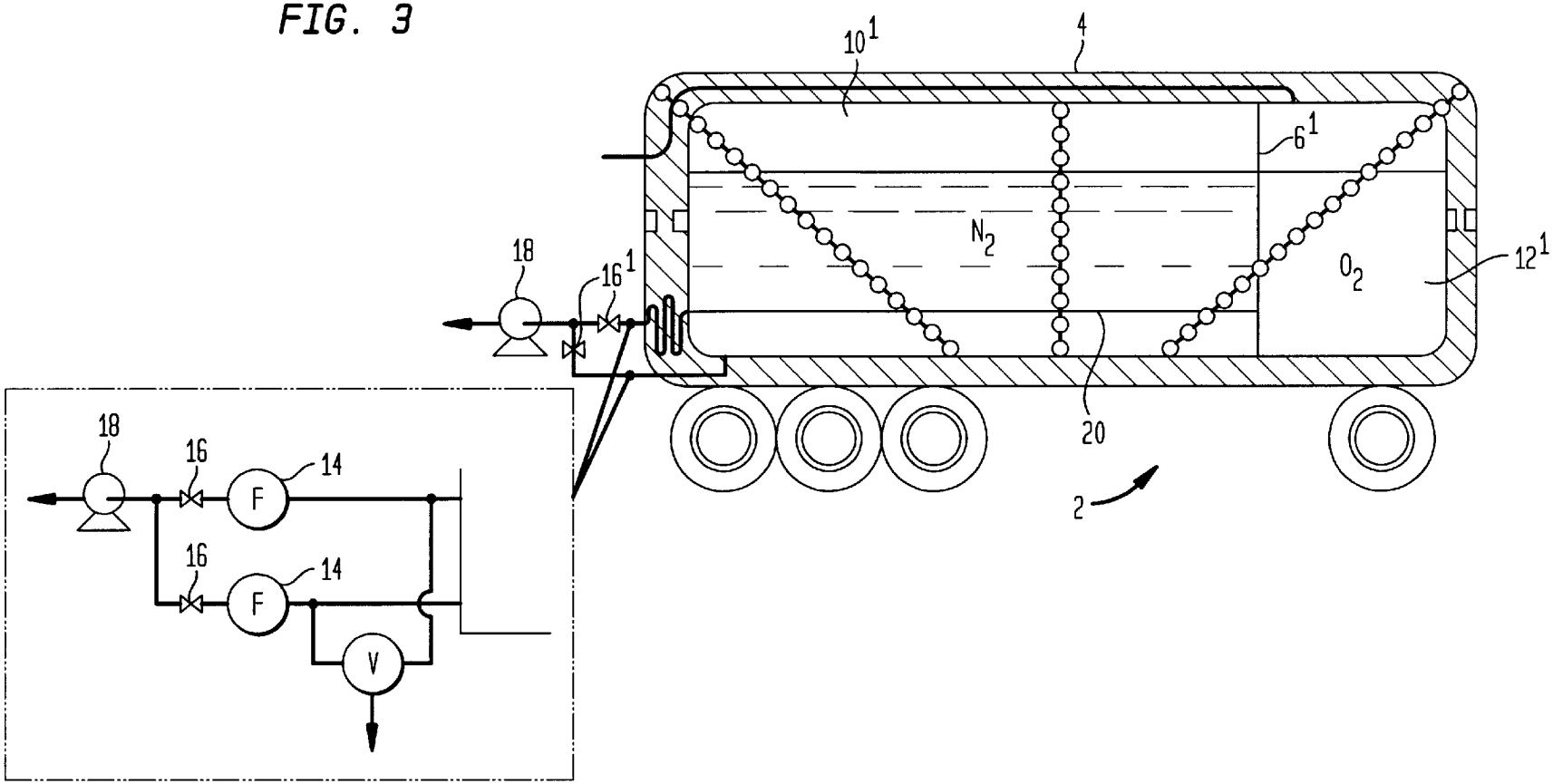
FIG. 3 is a schematic cross sectional view of a second embodiment of a road tanker for transporting cryogenic liquid in accordance with the invention.

In the embodiment shown in FIG. 3 the planar membrane 6' is disposed perpendicular to the axis of the cylindrical container 4 and so as to provide a first compartment 10' for liquid nitrogen at one end of the container 4 (to the rear of the vehicle 2, as shown, for example) which is of approximately four times the volume of the second part 12' for containing liquid oxygen at the other end of the cylinder. A pump 18 is provided for withdrawing and dispensing a mixture of nitrogen and oxygen from the container 4, liquid flow meters 14 and control valves 16 being provided so as to enable the flow of each cryogen to be controlled in order that a gas mixture of a particular composition can be dispensed. The liquid oxygen supply line 20 for the liquid oxygen from part 12' of the container 4 passes through the other part 10' of the container 4, which arrangement allows for finally equilibrating the temperature between the two liquids by heat transfer therebetween, through the walls of the pipe 20.

Means such as a linked pressure control valve which although not shown, acts as a slave to one of the parts 10, 12, 10', 12' are provided so as to maintain substantially equal pressures therein in order to avoid stress on the dividing membrane 6, 6'.

Although described herein in relation to a road tanker, it will readily be appreciated by those skilled in the art that the principles of this invention are applicable to any form of insulating container for transporting, or for storing, cryogenic liquids. Moreover, although only a container subdivided into two parts has been specifically described herein, this invention is equally applicable to containers divided into three or more parts, and the general concept of locating the membranes so as to divide the container into different parts, each having a volume roughly in proportion to the amount of each gas to be dispensed in a gas mixture, is equally applicable thereto.

I claim:

1. A tanker for transporting cryogenic liquid comprising:

an insulated container internally divided into at least two parts by at least one membrane, each of said at least two parts for containing a cryogenic liquid;

the at least one membrane formed of a material having similar thermal expansion properties to those of the container; and means for maintaining substantially equal pressure in each of the at least two parts.

2. The tanker as claimed in claim 1 comprising dispensing means for dispensing cryogenic liquid from each of the at least two parts of the container.

3. The tanker as claimed in claim 1 wherein the container is in the general configuration of a closed, horizontal cylinder and the at least one membrane is substantially planar.

4. The tanker as claimed in claim 3 wherein the insulated container has two of said parts and the at least one membrane is oriented substantially vertically and substantially parallel to the cylinderical axis of the cylinder.

5. The tanker as claimed in claim 4 wherein the at least one membrane is not coincident with the cylinderical axis of the cylinder.

6. The tanker as claimed in claim 3 wherein the insulated container has two of said parts and the at least one membrane is oriented substantially vertically and substantially transverse to a cylindrical axis of the container.

7. The tanker as claimed in claim 6 wherein the at least one embrane is closer to one of the ends than to the other of the ends of the cylinder.

8. The tanker as claimed in claim 1 further comprising means for dispensing cryogenic liquid from the at least two parts located at least adjacent one end of the container and a pipeline for dispensing cryogenic liquid from a distal part of the container directed through a proximal part of the container.

9. The tanker as claimed in claim 1 comprising means for controlling the dispensing means so as to dispense a mixture of cryogenic liquids in a predetermined ratio.

10. The tanker as claimed in claim 1 wherein the means for maintaining substantially equal pressure in each part are effective to maintain equal pressure during dispensing.

* * * * *